US008995857B2

(12) United States Patent
Iguchi et al.

(10) Patent No.: US 8,995,857 B2
(45) **Date of Patent: *Mar. 31, 2015**

(54) IMAGE FORMING APPARATUS

(71) Applicants: Kabushiki Kaisha Toshiba, Tokyo (JP); Toshiba Tec Kabushiki Kaisha, Tokyo (JP)

(72) Inventors: Ken Iguchi, Shizuoka-ken (JP); Hiroyuki Taguchi, Shizuoka-ken (JP); Minoru Yoshida, Tokyo (JP); Osamu Takagi, Tokyo (JP); Takahito Kabai, Shizuoka-ken (JP); Yoshiaki Kaneko, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/084,336

(22) Filed: Nov. 19, 2013

(65) Prior Publication Data

US 2014/0112693 A1 Apr. 24, 2014

Related U.S. Application Data

(60) Division of application No. 13/910,845, filed on Jun. 5, 2013, now Pat. No. 8,615,177, which is a continuation of application No. 12/699,286, filed on Feb. 3, 2010, now Pat. No. 8,478,151.

(60) Provisional application No. 61/150,262, filed on Feb. 5, 2009, provisional application No. 61/150,263, filed on Feb. 5, 2009.

(51) Int. Cl.
*G03G 15/20* (2006.01)
*G03G 13/20* (2006.01)

(Continued)

(52) U.S. Cl.
CPC ..... *G03G 13/20* (2013.01); *B41J 3/546* (2013.01); *B41J 29/36* (2013.01); *G03G 15/0178* (2013.01); *G03G 15/6558* (2013.01);

(Continued)

(58) Field of Classification Search
USPC ..... 399/38, 67, 110, 331; 347/101; 432/32
See application file for complete search history.

(56) References Cited

U.S. PATENT DOCUMENTS

| | | | |
|---|---|---|---|
| 6,527,384 | B2 | 3/2003 | Isago |
| 6,889,012 | B2 | 5/2005 | Morimoto |
| 2010/0272449 | A1 | 10/2010 | Yoshida et al. |

FOREIGN PATENT DOCUMENTS

| | | |
|---|---|---|
| JP | 5-127571 | 5/1993 |
| JP | 6-301315 | 10/1994 |

*Primary Examiner* — David Bolduc
*Assistant Examiner* — Barnabas Fekete
(74) *Attorney, Agent, or Firm* — Patterson & Sheridan LLP

(57) ABSTRACT

An image forming apparatus includes: a first image forming unit configured to form an image on a sheet using a first colorant to be heat-fixed on the sheet; a second image forming unit configured to form an image on the sheet using a second colorant that is erasable by heating; and a fixing device arranged further on a downstream side in a sheet conveying direction than the first image forming unit and further on an upstream side in the sheet conveying direction than the second image forming unit and capable of executing fixing processing for heat-fixing the image, which is formed on the sheet by the first image forming unit, on the sheet and executing erasing processing for heating the sheet, on which the image is formed with the second colorant, to erasing temperature to thereby erase the second colorant on the sheet.

10 Claims, 11 Drawing Sheets

(51) Int. Cl.

| | |
|---|---|
| ***B41J 3/54*** | (2006.01) |
| ***B41J 29/36*** | (2006.01) |
| ***G03G 15/01*** | (2006.01) |
| ***G03G 15/00*** | (2006.01) |
| ***G03G 13/22*** | (2006.01) |
| *G03G 15/23* | (2006.01) |

(52) U.S. Cl.

CPC ..... *G03G 15/6573* (2013.01); *G03G 13/22* (2013.01); *G03G 2215/00021* (2013.01); *G03G 2215/0043* (2013.01); *G03G 2215/00531* (2013.01); *G03G 2215/0482* (2013.01); *G03G 15/235* (2013.01)

USPC ..... 399/63; 347/101

IMAGE FORMING APPARATUS

CROSS-REFERENCE TO RELATED APPLICATIONS

This application claims benefit of U.S. patent application Ser. No. 13/910,845, filed Jun. 5, 2013, which claims benefit of U.S. patent application Ser. No. 12/699,286, filed Feb. 3, 2010, now U.S. Pat. No. 8,478,151, which claims the benefit of U.S. Provisional Application No. 61/150,262, filed on Feb. 5, 2009, and U.S. Provisional Application No. 61/150,263, filed on Feb. 5, 2009, each of which are herein incorporated by reference.

TECHNICAL FIELD

This specification relates to a technique for, in an image forming apparatus having both of an image forming function of heat-fixing a colorant on a sheet using a fixing device and an image forming function of forming an image on the sheet using a colorant erasable by heating, making it possible to apply normal image formation processing using the erasable colorant to a sheet on which the image is erased by the fixing device.

BACKGROUND OF THE INVENTION

In the past, there is known an image forming apparatus having both of an image forming function of heat-fixing a toner on a sheet to form an image and an image forming function of forming an image on a sheet in an ink jet system.

Concerning the image forming function of performing image formation in the ink jet system, there is also known a configuration that uses an ink that can be erased by heating.

There is known a configuration for, in order to erase an image erasable by heating formed on a sheet in this way and reuse the sheet, erasing the image by heating the sheet with a fixing device included in an image that forms the erasable image.

There is known a configuration for in an image forming apparatus, for the purpose of a reduction in cost and space saving, realizing processing for heat-fixing a toner and processing for heating an image of the erasable ink to erase the ink using one fixing device (see, for example, JP-A-5-127571 and JP-A-6-301315).

There is known a configuration for applying erasing processing by a fixing device to a sheet on which an image is formed by an erasable ink and then applying image formation processing by the erasable ink to the sheet on which the image is erased by heating.

However, the temperature of the sheet immediately after the image erased by heating with the fixing device is extremely high. Even if it is attempted to apply the image formation processing by the erasable ink to the sheet immediately after the erasing having such high temperature, in some cases, the erasable ink is erased by the heat of the sheet immediately after the erasing and the image formation processing cannot be normally performed.

SUMMARY OF THE INVENTION

In order to solve the problem, this specification relates to an image forming apparatus including: a first image forming unit configured to form an image on a sheet using a first colorant to be fixed on the sheet by heating; a second image forming unit configured to form an image on the sheet using a second colorant that is erasable by heating to predetermined erasing temperature; and a fixing device arranged further on a downstream side in a sheet conveying direction than the first image forming unit and further on an upstream side in the sheet conveying direction than the second image forming unit and capable of executing fixing processing for nipping and conveying the sheet, on which the image is formed by the first image forming unit, while heating the sheet to thereby fix the image on the sheet and executing erasing processing for heating the sheet, on which the image is formed with the second colorant, to the predetermined erasing temperature to thereby erase the second colorant on the sheet.

This specification relates to an image forming apparatus including: a first image forming unit configured to form an image on a sheet using a first colorant to be fixed on the sheet by heating; a second image forming unit configured to form an image on the sheet using a second colorant that is erasable by heating to predetermined erasing temperature; a fixing device capable of executing fixing processing for nipping and conveying the sheet, on which the image is formed by the first image forming unit, while heating the sheet to thereby fix the image on the sheet and executing erasing processing for heating the sheet, on which the image is formed with the second colorant, to the predetermined erasing temperature to thereby erase the second colorant on the sheet; a sheet conveying unit capable of executing sheet conveying operation for conveying the sheet subjected to the erasing processing by the fixing device to the second image forming unit and causing the second image forming unit to apply the image formation processing to the sheet; and a processing control unit configured to control the sheet conveying operation by the sheet conveying unit such that, when the second image forming unit applies the image formation processing to the sheet subjected to the erasing processing by the fixing device, required time that elapses until the sheet reaches the second image forming unit from the fixing device is equal to or longer than predetermined cooling time.

DETAILED DESCRIPTION

Embodiments of the present invention are explained below with reference to the accompanying drawings.

First Embodiment

First, a first embodiment of the present invention is explained.

Figure 1:
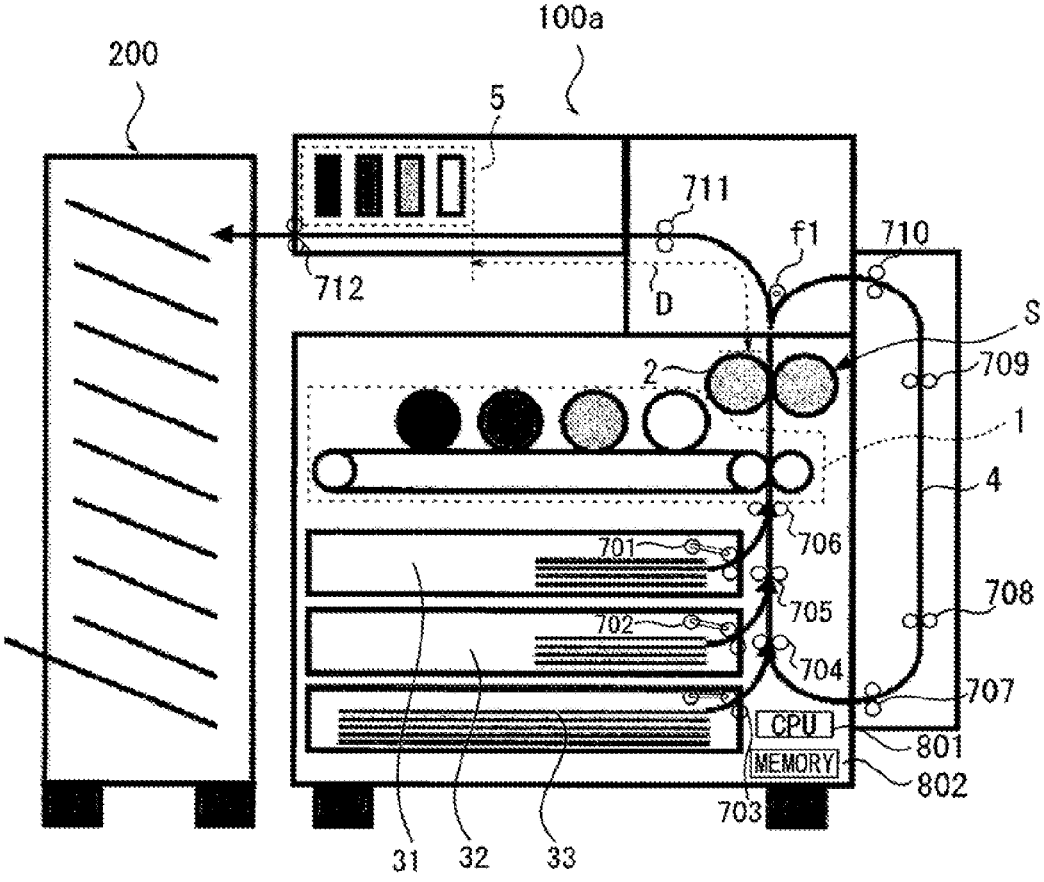
FIG. 1 is a longitudinal sectional view of the schematic configuration of an image forming system according to a first embodiment of the present invention.

FIG. 1 is a longitudinal sectional view of the schematic configuration of an image forming system according to the first embodiment.

As shown in FIG. 1, the image forming system according to the first embodiment includes an image forming apparatus (a MFP: Multi Function Peripheral) 100*a* and a finisher 200.

The finisher 200 has a function of applying predetermined post-processing to a sheet discharged from an image forming apparatus 100*a* such as a sheet on which an image is formed by the image forming apparatus 100. Examples of the "predetermined post-processing" include stapling, punching, folding, sorting, and bookbinding.

The image forming apparatus (the MFR: Multi Function Peripheral) 100*a* includes a first image forming unit 1, a fixing device 2, cassettes 31 to 33, a reversal conveying path 4, a second image forming unit 5, sheet feeding rollers 701 to 703, conveying rollers 704 to 711, a discharge roller 712, a flapper f1, a temperature-information acquiring unit S, a CPU (a processing control unit) 801, a memory 802, a display unit 803, and an operation input unit 804.

The components included in the image forming apparatus 100*a* are explained in detail below.

The first image forming unit 1 forms an image on a sheet using a first colorant that is fixed on the sheet by heating. Examples of the first colorant include a toner.

The second image forming unit 5 forms an image on the sheet using a second colorant erasable by heating to predetermined erasing temperature.

Specifically, in this embodiment, the second image forming unit 5 forms an image on the sheet in an ink jet system. Therefore, as the second colorant, an "erasable ink" used for image formation by the ink jet system is adopted.

It goes without saying that an image forming system adoptable in the second image forming unit 5 is not limited to the ink jet system and, for example, a so-called electrophotographic system can also be adopted. When the electrophotographic system is adopted in the second image forming unit 5, for example, an "erasable toner" is used as the second colorant used in the second image forming unit 5.

The second image forming unit 5 is arranged further on a downstream side in a sheet conveying direction than the fixing device 2 and further on an upstream side in a sheet conveying direction than the discharge roller 712 at the final stage for sheet conveyance in the image forming apparatus.

The fixing device 2 is arranged further on the downstream side in the sheet conveying direction than the first image forming unit 1 and further on the upstream side in the sheet conveying direction than the second image forming unit 5.

The fixing device 2 can execute "fixing processing" for nipping and conveying a sheet, on which a toner image is formed by the first image forming unit 1, while heating the sheet to thereby fix the image on the sheet.

The fixing device 2 can execute erasing processing for heating a sheet, on which an image is formed with the erasable ink, to predetermined erasing temperature (e.g., 80° C.) to thereby erase the erasable ink on the sheet.

The cassettes 31 to 33 (equivalent to a first sheet feeding unit) are located further on the upstream side in the sheet conveying direction than the first image forming unit 1. A predetermined number of sheets can be tacked and stored in each of the cassettes 31 to 33. The cassettes 31 to 33 can respectively store sheets of sizes different from one another. The sheets stored in the cassettes 31 to 33 are picked up and separated by the sheet feeding rollers 701 to 703 and fed to a sheet conveying path one by one. The conveying rollers 704 to 706 convey the sheet fed to the sheet conveying path to the first image forming unit 1.

In the sheet conveying path in the image forming apparatus 100*a* according to this embodiment, the sheet fed from the cassettes 31 to 33 to the sheet conveying path is conveyed through the first image forming unit 1, the fixing device 2, and the second image forming unit 5 in this order. With such a configuration, it is possible to apply the image formation by both the first image forming unit 1 and the second image forming unit 5 to the sheet fed from the cassettes 31 to 33. Further, it is possible to execute sheet conveying operation for discharging the sheet subjected to the fixing processing by the fixing device 2 to the outside of the apparatus through the second image forming unit 5.

The reversal conveying path 4 is used in reversing a sheet, on a first surface of which a toner image is formed by the first it age forming unit 1, and applying the image formation processing by the first image forming unit 1 to a second surface of the sheet. Sheet conveyance in the reversal conveying path 4 is performed by the conveying rollers 707 to 710 controlled to be driven by the CPU 801.

The flapper f1 has a role of switching a conveying path of the sheet finished passing the first image forming unit 1, that is, the sheet conveying path toward the second image forming unit 5 or the reversal conveying path 4. Operation for switching a conveying direction by the flapper f1 is controlled by the CPU 801.

The conveying roller 711 nips and conveys the sheet, which is guided to be directed to the sheet conveying path to the second image forming unit 5 by the flapper f1, and conveys the sheet to the second image forming unit 5.

The discharge roller 712 has a role of discharging the sheet finished passing the second image forming unit 5 to the outside of the image forming apparatus 100*a*. The discharge roller 712 is a roller at a final stage in the image forming apparatus 100*a*. In the image forming system according to this embodiment, the sheet discharged by the discharge roller 712 is passed to the finisher 200.

The sheet feeding rollers 701 to 703, the conveying rollers 704 to 711, the discharge roller 712, and the flapper f1 cooperate with one another to realize a function of a "sheet conveying unit". The sheet feeding rollers 701 to 703, the conveying rollers 704 to 711, the discharge roller 712, and the flapper f1 can be separately controlled to be driven by the CPU 801.

The "sheet conveying unit" having the configuration explained above can perform, according to the driving control by the CPU 801, sheet conveying operation for conveying a sheet subjected to "erasing processing" by the fixing device 2 to the second image forming unit 5 and causing the second image forming unit 5 to apply the image formation processing to the sheet.

The temperature-information acquiring unit S acquires information concerning the temperature of the fixing device 2. For example, when the temperature-information acquiring unit S is realized by a temperature sensor or the like, the "information concerning the temperature of the fixing device 2" is, for example, a measurement value of surface temperature of a roller surface of at least one of a heating roller and a pressing roller included in the fixing device 2. It goes without saying that the information acquired by the temperature-information acquiring unit S does not need to be a temperature measurement value itself and may be a voltage value or a current value corresponding to the temperature measurement value.

The CPU (the processing control unit) 801 has a role of performing various kinds of processing in the image forming apparatus and a role of executing a computer program stored in the memory 802 to thereby realize various functions of the image forming apparatus 100*a*.

Specifically, when the image formation processing by the second image forming unit 5 is applied to a sheet subjected to the "erasing processing" by the fixing device 2, the CPU (the processing control unit) 801 controls the conveying operation by the sheet conveying unit such that required time that elapses until the sheet reaches the second image forming unit 5 from the fixing device 2 is equal to or longer than predetermined cooling time.

The memory 802 can include a RAM (Random Access Memory), a ROM (Read Only Memory), a DRAM (Dynamic Random Access Memory), a SRAM (Static Random Access Memory), or a VRAM (Video RAM). The memory 802 has a role of storing various kinds of information and computer programs used in the image forming apparatus.

A flow of the operation and processing of the image forming apparatus according to this embodiment is explained below.

In the following explanation, a sheet subjected to the erasing processing by the fixing device 2 is directly conveyed to the second image forming unit 5 and the image formation processing by the second image forming unit 5 is applied to the sheet immediately after the erasing processing is applied.

The sheet immediately after passing the fixing device 2 to be subjected to the erasing processing is still in a high-temperature state. Even if image formation processing by the erasable ink is applied to the sheet in the high-temperature state in this way by the second image forming unit 5, the ink is erased by heat of the sheet itself. Therefore, in this embodiment, the problem is solved by a flow of processing explained below.

Figure 2:
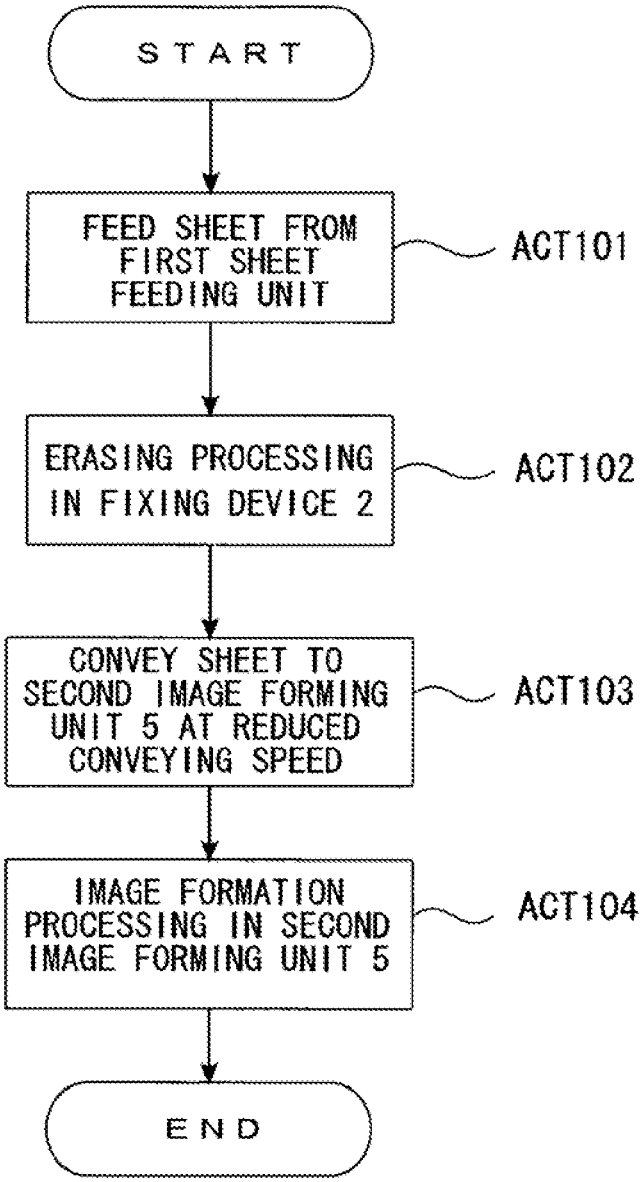
FIG. 2 is a flowchart for explaining a flow of processing in an image forming apparatus according to the first embodiment.

FIG. 2 is a flowchart for explaining a flow of processing in the image forming apparatus according to the first embodiment.

The CPU 801 controls to drive the conveying rollers included in the sheet conveying unit to convey a sheet as a target of the erasing processing from any one of the cassettes 31 to 33 to the fixing device 2 (ACT 101).

Subsequently, the CPU 801 applies the erasing processing to the sheet in the fixing device 2 (ACT 102). The temperature of the fixing device 2 is controlled to be, for example, equal to or higher than 80° C.

The CPU 801 controls to drive the conveying rollers included in the sheet conveying unit to perform, in a state in which sheet conveying speed is reduced than usual, sheet conveyance such that time until the sheet subjected to the erasing processing by the fixing device 2 reaches the second image forming unit 5 after being discharged from the fixing device 2 exceeds the predetermined cooling time (ACT 103).

In this way, required time until the sheet subjected to the erasing processing reaches the second image forming unit 5 is set to time in which the sheet is cooled to temperature enough for not erasing the erasable ink. Therefore, the sheet subjected to the erasing processing reaches the second image forming unit 5 in a temperature state that does not cause a problem in performing image formation by the erasable ink.

The second image forming unit 5 applies the image formation processing by the erasable ink to the sheet (ACT 104).

In the control of conveying speed for the sheet until the sheet reaches the second image forming unit 5 after being discharged from the fixing device 2, for example, it is desirable that conveying speed in at least a part of a sheet conveyance section D in conveying the sheet subjected to the "erasing processing" by the fixing device 2 to the second image forming unit 5 be reduced to be lower than conveying speed in conveying the sheet subjected to the "fixing processing" by the fixing device 2 to the second image forming unit 5.

As a method of reducing the sheet conveying speed, for example, conveyance in the following speed distribution is conceivable:

(1) reduction of the speed in a former half of the sheet conveyance section D;

(2) reduction of the speed in a latter half of the sheet conveyance section D;

(3) reduction of the speed in the middle of the sheet conveyance section D; and (4) law-speed conveyance at fixed speed in the entire area of the sheet conveyance section D.

It goes without saying that the method only has to be a conveying method that can resultantly set sheet conveyance time from the fixing device 2 to the second image forming unit 5 long and is not limited to the examples explained above.

As a place for storing the sheet as the target of the erasing processing by the fixing device 2 (a sheet feeding unit for erasing), for example, any one of the cassettes 31 to 33 also usable as sheet cassettes for normal copy paper and the like can also be adopted.

Second Embodiment

A second embodiment of the present invention is explained below.

The second embodiment is a modification of the first embodiment. Components same as those explained in the first embodiment are denoted by the same reference numerals and signs and explanation of the components is omitted.

Figure 3:
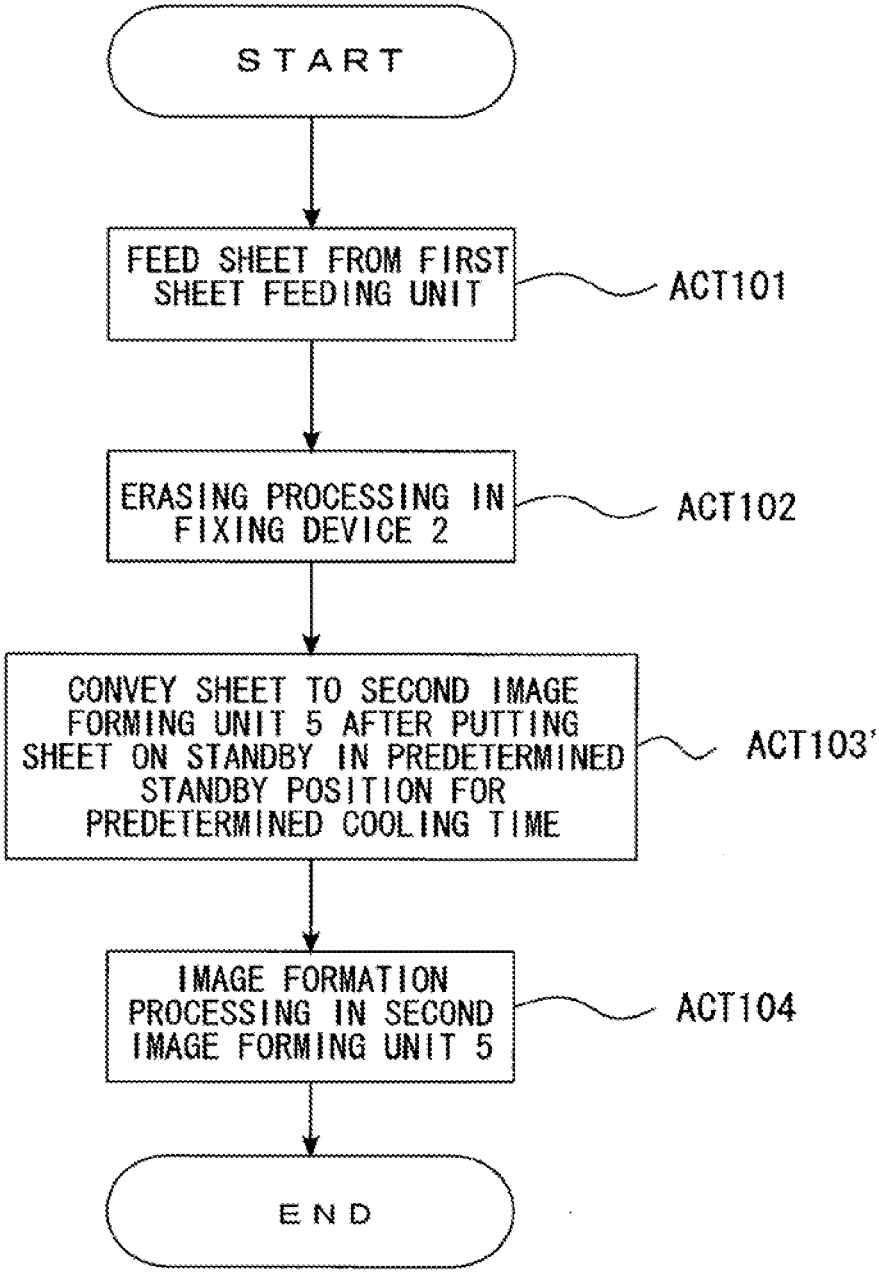
FIG. 3 is a flowchart for explaining a flow of processing in an image forming apparatus according to a second embodiment of the present invention.

FIG. 3 is a flowchart for explaining a flow of processing in an image forming apparatus according to the second embodiment. ACT 101, ACT 102, and ACT 104 shown in FIG. 3 are the same as ACT 101, ACT 102, and ACT 104 shown in FIG. 2. Therefore, only ACT 103' is explained below.

The CPU 801 controls to drive the conveying rollers included in the sheet conveying unit to temporarily stop the sheet subjected to the erasing processing by the fixing device 2 in a period until the sheet reaches the second image forming unit 5 and, after securing sufficient cooling time, resumes the conveyance of the sheet and feeds the sheet to the second image forming unit 5 (ACT 103').

Figure 4:
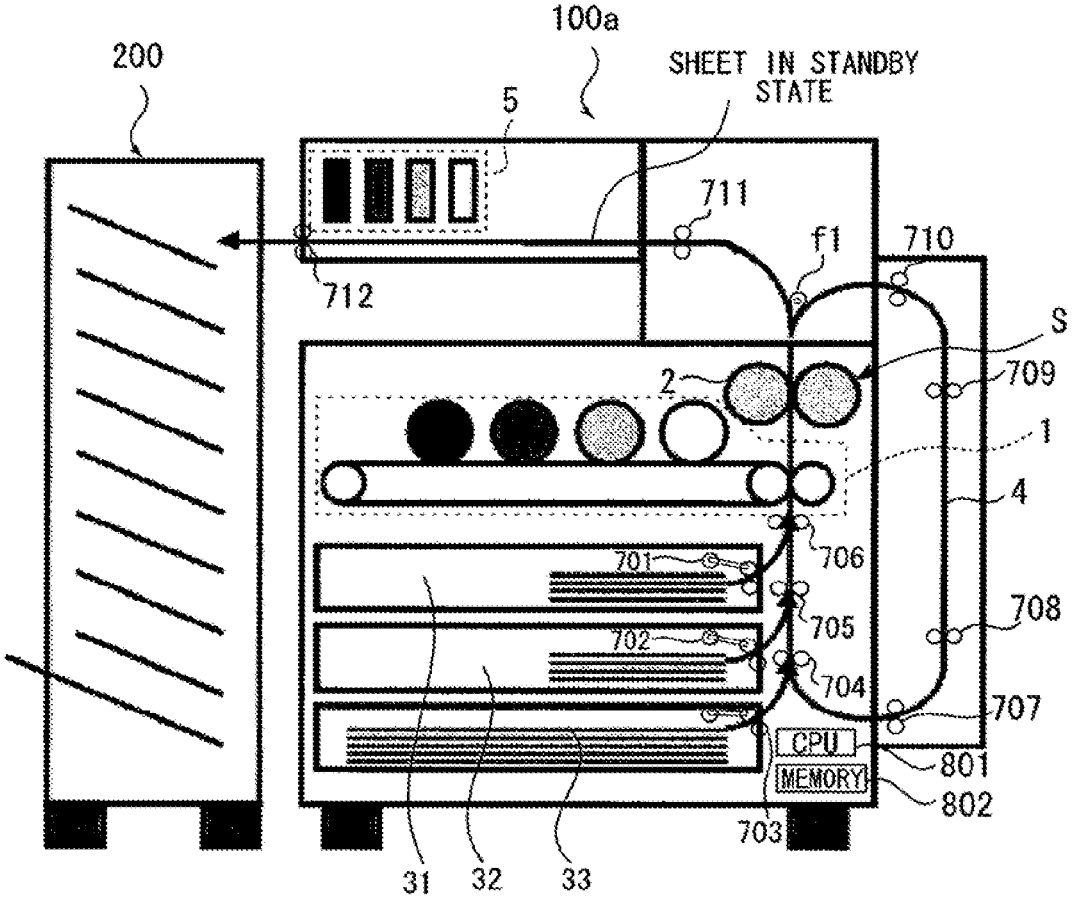
FIG. 4 is a diagram of a state in which a sheet subjected to erasing processing by a fixing device 2 is temporarily stopped in a period until the sheet reaches a second image forming unit 5.

FIG. 4 is a diagram of a state in which the sheet subjected to the erasing processing by the fixing device 2 is temporarily stopped in a period until the sheet reaches the second image forming unit 5.

In this way, required time until the sheet subjected to the erasing processing reaches the second image forming unit 5 is set to time in which the sheet is cooled to temperature enough for not erasing the erasable ink. Therefore, the sheet subjected to the erasing processing reaches the second image forming unit 5 in a temperature state that does not cause a problem in performing image formation by the erasable ink (e.g., a temperature state lower than 80° C.).

Third Embodiment

A third embodiment of the present invention is explained below.

The third embodiment is a modification of the embodiments explained above. Components having functions same as those of the components explained in the embodiments are denoted by the same reference numerals and signs and explanation of the components is omitted.

Figure 5:
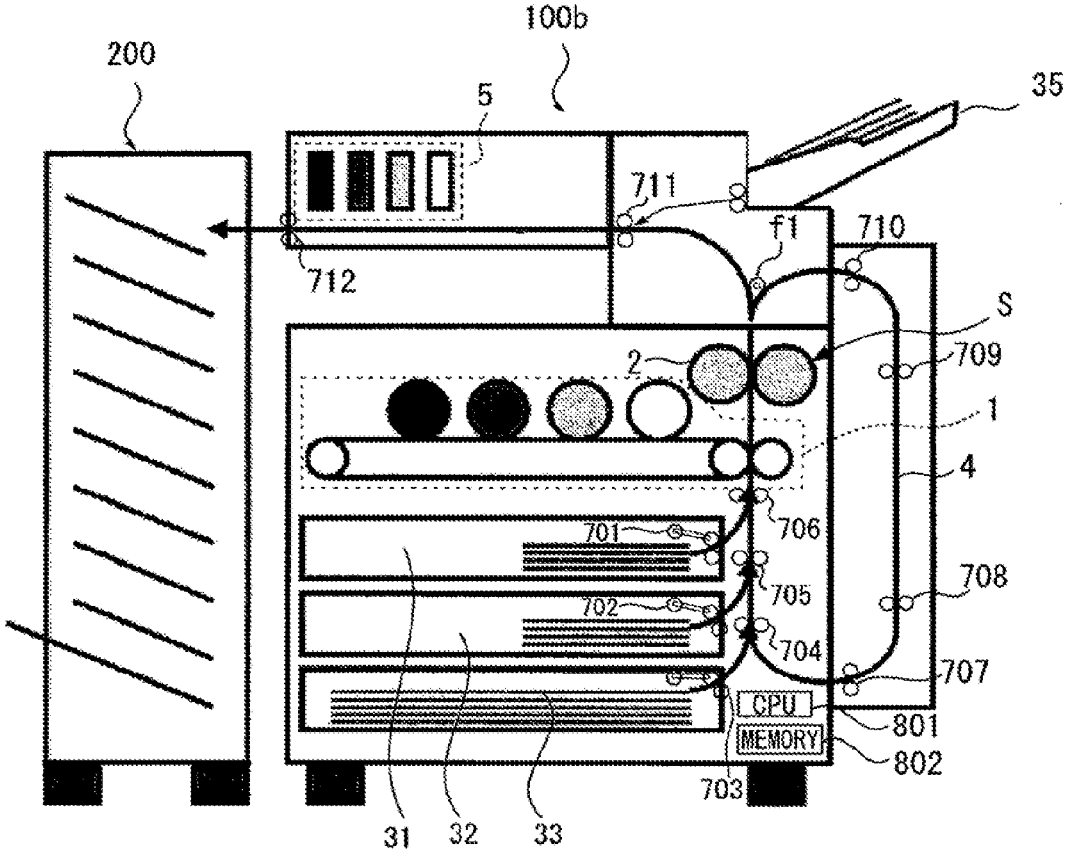
FIG. 5 is a longitudinal sectional view for explaining an image forming apparatus 100*b* according to a third embodiment of the present invention.

FIG. 5 is a longitudinal sectional view for explaining an image forming apparatus 100*b* according to the third embodiment.

The image forming apparatus 100*b* according to the third embodiment includes a cassette 35 (a second sheet feeding unit) as a sheet feeding unit exclusively for the second image forming unit 5. In the cassette 35, not only sheets not subjected to the image formation processing but also sheets subjected to the erasing processing while not being subjected to the image formation processing can be stacked.

The cassette 35 includes, between the fixing device 2 and the second image forming unit 5 in the sheet conveying direction, a conveying path for feeding sheets.

In general, immediately after the first image forming unit 1 executes the image formation processing, the fixing device 2 is still in a high-temperature state. Therefore, even if it is attempted to feed a sheet from the cassettes 31 to 33 and apply the image formation to the sheet in the second image forming unit 5 in an attempt to apply the image formation by the second image forming unit 5 immediately after the fixing processing, the sheet is heated to extremely high temperature by the fixing device 2 when the sheet passes the fixing device 2. Therefore, the erasable ink is immediately erased even if the image formation processing by the second image forming unit 5 is performed.

On the other hand, according to this embodiment, the sheet fed from the cassette 35 reaches the second image forming unit 5 without passing the fixing device 2. Therefore, even if the fixing device 2 is still in the high-temperature state, the temperature of the sheet conveyed to the second image forming unit 5 does not rise. The image formation processing by the erasable ink can be normally applied.

Compared with the sheet feeding from the cassettes 31 to 33 usually included in the image forming apparatus, a curvature of the sheet conveying path reaching the second image forming unit 5 can be set in a gentle state. Even when thick paper is used as a recording medium, occurrence of a sheet jam (so-called "jam") can be substantially suppressed. The image formation processing by the ink jet system has an advantage that accuracy is high even in thick paper printing because a recording head does not come into contact with a sheet.

As explained above, since the recording head does not come into contact with the sheet in the image formation processing by the ink jet system, the sheet passing the second image forming unit 5 is not damaged. Therefore, if the cassette 35 is used as an inserter and the sheet is conveyed to the finisher 200 without being subjected to the image formation processing by the second image forming unit 5, it is also possible to apply only finishing such as binding and punching to the sheet. Specifically, when the image formation processing by one of the first and second image forming units is applied to the sheet fed from any one of the cassettes 31 to 33, the CPU (the processing control unit) 801 can cause the sheet conveying unit to feed, as an inserting sheet, the sheet fed by the cassette 35.

Figure 6:
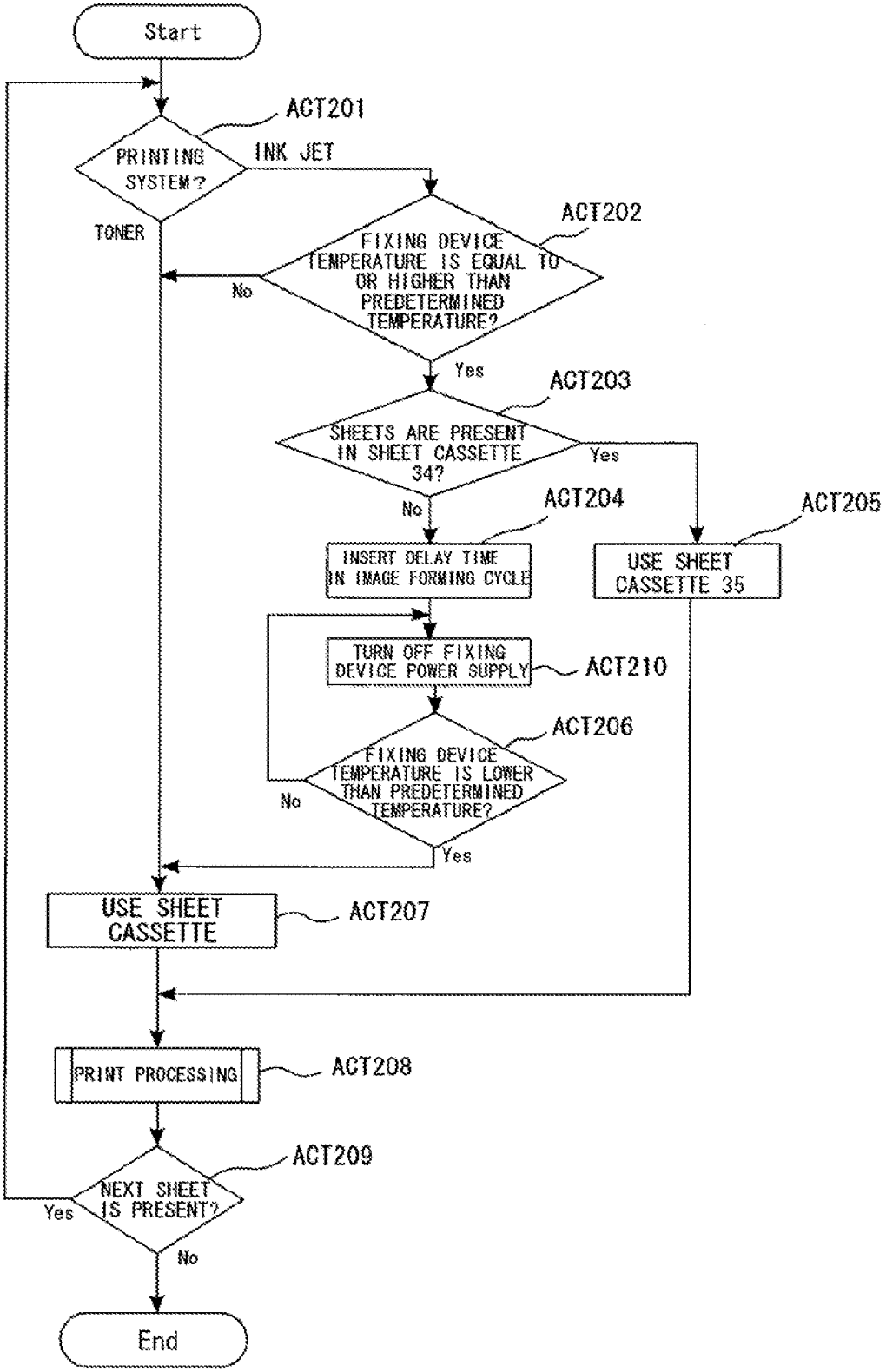
FIG. 6 is a flowchart for explaining a flow of processing in the image forming apparatus according to the third embodiment.

FIG. 6 is a flowchart of a flow of processing in the image forming apparatus according to the third embodiment.

First, when print processing is instructed, the CPU 801 checks whether the print processing is printing performed by using a toner or printing performed by using ink (ACT 201).

If the print processing is the printing performed by using a toner (toner in ACT 201), the CPU 801 causes the sheet conveying unit to feed a sheet from any one of the cassettes 31 to 33 (ACT 207) and causes the first image forming unit 1 to execute the print processing (ACT 208).

On the other hand, if the print processing is the printing performed by using ink (ink in ACT 201), the CPU 801 determines, on the basis of information acquired by the temperature-information acquiring unit S, whether the temperature of the fixing device 2 is equal to or higher than predetermined temperature (ACT 202). If the temperature of the fixing device 2 is lower than the predetermined temperature (No in ACT 202), the CPU 801 causes the sheet conveying unit to feed a sheet from any one of the cassettes 31 to 33 (ACT 207) and causes the second image forming unit 5 to execute the print processing (ACT 208).

On the other hand, if the temperature of the fixing device 2 is equal to or higher than the predetermined temperature (Yes in ACT 202), the CPU 801 checks presence or absence of sheets in the cassette 35 (ACT 203). If sheets are present in the cassette 35 (Yes in ACT 203), the CPU 801 performs sheet feeding from the cassette 35 (ACT 205) and causes the second image forming unit 5 to execute the print processing (ACT 208).

If no sheet is present in the cassette 35 (NO in ACT 203), the CPU 801 sets delay time in an image forming cycle (ACT 204) and turns off a power supply for the fixing device 2 (ACT 110). The CPU 801 stays on standby, on the basis of information acquired by the temperature-information acquiring unit S, until the temperature of the fixing device 2 falls below the predetermined temperature (Yes in ACT 206). Thereafter, the CPU 801 performs sheet feeding from any one of the cassettes 31 to 33 (ACT 207) and causes the second image forming unit 5 to execute the print processing (ACT 208). If there is a sheet that should be processed next (Yes in ACT 209), the CPU 801 repeats the processing.

The "predetermined temperature" is temperature at which, when a sheet finished passing the fixing device 2 in a state of the "predetermined temperature" reaches the second image forming unit 5, the temperature of the sheet falls below the predetermined erasing temperature (e.g., 80° C.).

In an example explained with reference to the flowchart, the sheet feeding from the cassettes 31 to 33 is given priority if the temperature of the fixing device 2 is lower than the predetermined temperature in ACT 202. However, the present invention is not limited to this. For example, when sheets are present in the cassette 35, the sheet feeding from the cassette 35 may be given priority.

With the configuration explained above, even when the print processing performed by using a toner is applied, and the fixing device 2 has high temperature, it is possible to immediately start print processing performed by using the erasable ink.

Fourth Embodiment

A fourth embodiment of the present invention is explained below.

The fourth embodiment is a modification of the embodiments explained above. Components having functions same as those of the components explained in the embodiments are denoted by the same reference numerals and signs and explanation of the components is omitted.

Figure 7:
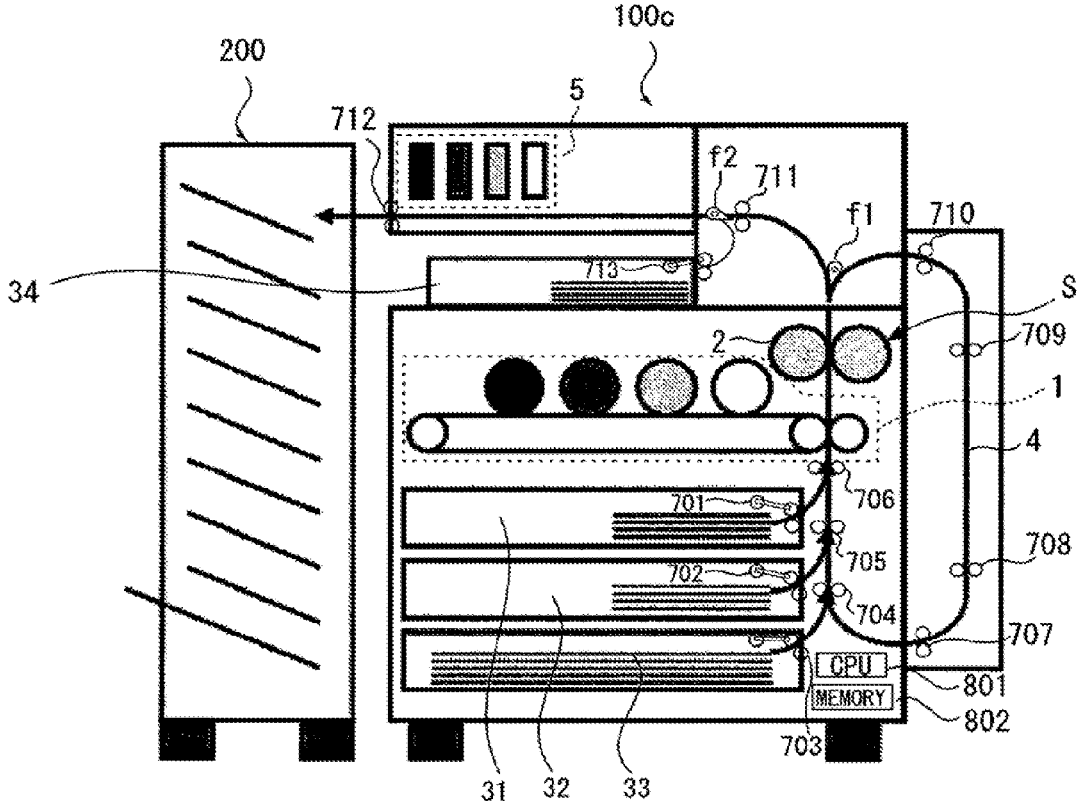
FIG. 7 is a longitudinal sectional view for explaining the configuration of an image forming apparatus 100*c* according to the third embodiment.

FIG. 7 is a longitudinal sectional view for explaining the configuration of an image forming apparatus 100*c* according to the fourth embodiment.

The image forming apparatus 100*c* according to the fourth embodiment further includes a stacking unit 34 and a flapper f2 in addition to the configuration of the image forming apparatus 100*a* according to the first embodiment.

Figure 8:
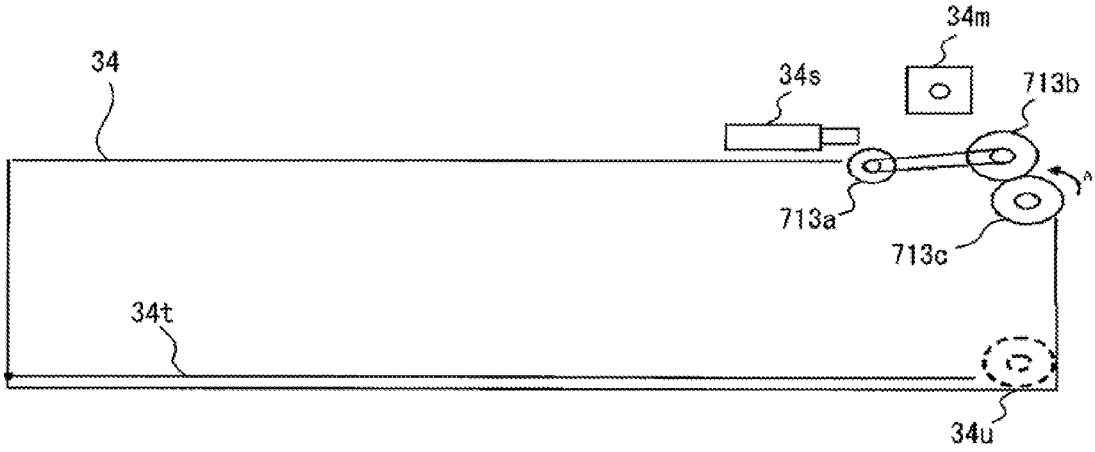
FIG. 8 is a longitudinal sectional view for explaining details of the configuration of a stacking unit 34.
Figure 9:
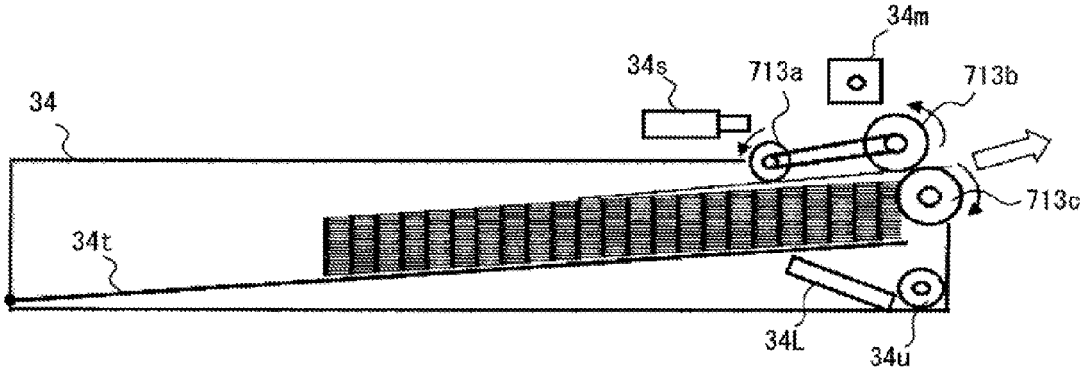
FIG. 9 is a longitudinal sectional view for explaining details of the configuration of the stacking unit 34.
Figure 10:
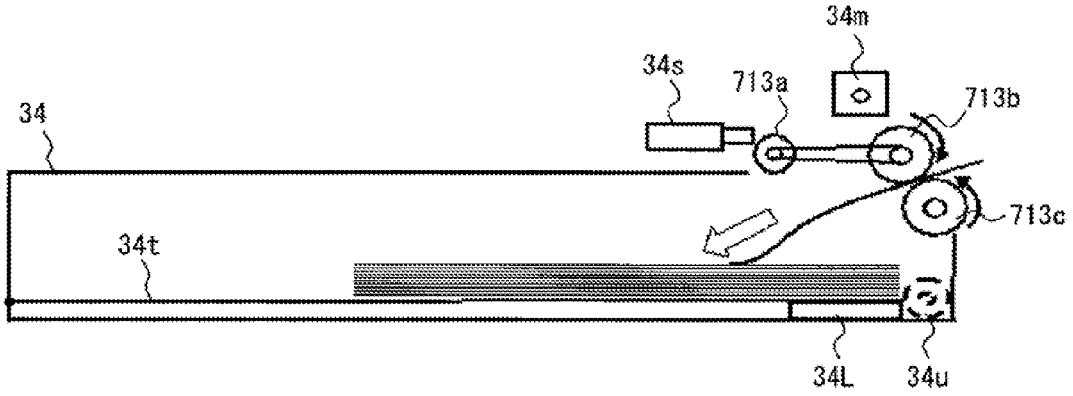
FIG. 10 is a longitudinal sectional view for explaining details of the configuration of the stacking unit 34.

FIGS. 8 to 10 are longitudinal sectional views for explaining details of the configuration of the stacking unit 34.

The stacking unit 34 is arranged in the sheet conveying path for conveying a sheet subjected to the "erasing processing" by the fixing device 2 to the second image forming unit 5. The sheet subjected to the "erasing processing" is stacked in the stacking unit 34. The stacking unit 34 can feed the stacked sheet to the sheet conveying path again.

The stacking unit 34 feeds the sheet to a position further on the downstream side in the sheet conveying direction than the fixing device 2 and further on the upstream side in the sheet conveying direction than the second image forming unit 5.

The stacking unit 34 in this embodiment includes a tray 34*t*, a tray-up motor 34*u*, a sheet feeding roller 713, a pickup roller solenoid 34*s*, a lever 34L, and a paper feeding and discharging motor 34*m*. The sheet feeding roller 713 includes a pickup roller 713*a*, a paper feeding and discharging roller 713*b*, and a separating roller 713*c*.

The tray-up motor 34*u* pushes up the bottom surface of the tray 34*t* with the level 34L to thereby lift the tray 34*t* and retracts the lever 34L downward to thereby lower the tray 34*t*. The tray-up motor 34*u* is controlled to be driven by the CPU 801 to push up the tray 34*t* during sheet feeding from the stacking unit 34 (see FIG. 9) and lower the tray 34*t* during sheet reception into the stacking unit 34 (see FIG. 10).

The pickup roller solenoid 34*s* is a driving source for moving the pickup roller 713*a* up and down. When the pickup roller solenoid 34*s* is turned on, the pickup roller 713*a* falls.

The paper feeding and discharging motor 34*m* is a driving source for the paper feeding and discharging roller 713*b* and the pickup roller 713*a*. When the paper feeding and discharging motor 34*m* is rotated in a normal direction, a sheet is fed from the stacking unit 34 to the sheet conveying path.

The pickup roller 713*a* is driven to rotate by the paper feeding and discharging motor 34*m* and controlled to move up and down by the pickup roller solenoid 34*s*.

The paper feeding and discharging roller 713*b* usually includes a one-way clutch and rotates only in one direction. However, in the image forming apparatus according to this embodiment, it is necessary to perform both the sheet discharge from the stacking unit 34 and the sheet reception in the stacking unit 34. Therefore, the paper feeding and discharging roller 713*b* can rotate in both directions.

The separating roller 173*c* is a driven roller not having a driving source. The separating roller 713*c* includes a spring joint and is urged in an A direction shown in FIG. 8. Therefore, when a sheet is discharged from the stacking unit 34, the separating roller 713*c* plays a role of a separating roller. However, when a sheet is received in the stacking unit 34, the separating roller 713*c* cannot play the role of the separating roller and functions as an ordinary driven roller.

When sheets are stacked in the stacking unit 34, a sheet may be fed preferentially from the stacking unit 34 during execution of the print processing.

Figure 11:
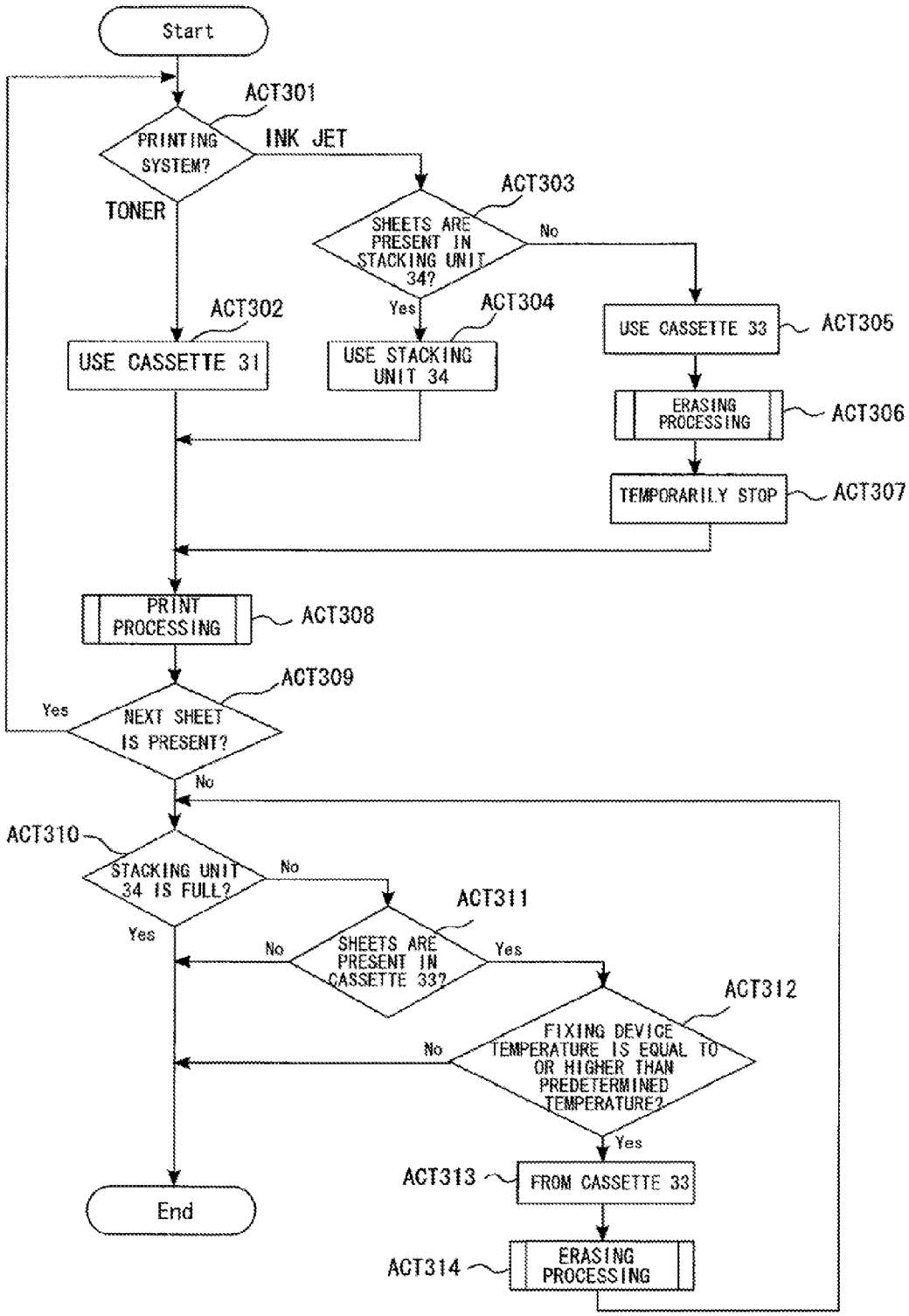
FIG. 11 is a flowchart for explaining a flow of processing in an image forming apparatus according to a fourth embodiment of the present invention.

FIG. 11 is a flowchart for explaining a flow of processing in the image forming apparatus according to the fourth embodiment.

In this embodiment, it is possible to select sheets stacked in the stacking unit 34 for use or sheets stored in any one of the normal cassettes 31 to 33 for use when the print processing is applied.

It is assumed that, for example, the stacking unit 34 is selected as a sheet feeding unit that is preferentially used. In this case, if the number of sheets used for the print processing is larger than the number of sheets stacked in the stacking unit 34, sheet feeding from the stacking unit 34 is preferentially performed and, after all the sheets in the stacking unit 34 are used, the sheet feeding unit is automatically switched to use the sheets in the cassettes 31 to 33. The cassette 33 is used as a cassette exclusively used for storing sheets that should be subjected to the erasing processing.

Specifically, in this embodiment, when the number of sheets stacked in the stacking unit 34 is equal to or larger than one, the CPU (the processing control unit) 801 causes the second image forming unit 5 to more preferentially use, for the image formation processing, a sheet fed from the stacking unit 4 than a sheet fed from the cassettes 31 and 32.

When the CPU (the processing control unit) 801 causes the second image forming unit 5 to execute the image formation processing using the sheets in the stacking unit 34, if the number of sheets as targets of the image formation processing is larger than the number of sheets stacked in the stacking unit 34, the CPU 801 causes the second image forming unit 5 to use a sheet fed from any one of the cassettes 31 to 33 after all the sheets stored in the stacking unit 34 are used.

When the CPU (the processing control unit) 801 executes the image formation processing by the first image forming unit 1, the CPU 801 selects, on the basis of setting content set in advance, a sheet fed from which of the cassettes 31 to 33 and the stacking unit 34 is used. The "setting content" may be content set by a user performing operation input using an operation input unit or the like normally provided in the image forming apparatus or content set in default when the image forming apparatus is shipped.

If a designated printing system is print processing performed by using a toner (toner in ACT 301), the CPU 801 causes the sheet conveying unit to feed a sheet from the cassette 31 (ACT 302) and causes the first image forming unit 1 to execute the image formation processing (ACT 308).

On the other hand, if the designated printing system is print processing performed by using ink (ink in ACT 301), the CPU 801 determines whether sheets are stored in the stacking unit 34 (ACT 303).

If sheets are stacked in the stacking unit 34 (Yes in ACT 303), the CPU 801 causes the second image forming unit 5 to apply the image formation processing to a sheet fed from the stacking unit 34 (ACT 304) (ACT 308).

If no sheet is stacked in the stacking unit 34 (No in ACT 303), the CPU 801 performs feeding of a sheet waiting for the "erasing processing" stored in, for example, the cassette 33 (ACT 305) and causes the fixing device 2 to execute the "erasing processing" on the sheet (ACT 306).

The sheet subjected to the "erasing processing" as explained above is heated to high temperature by the "erasing processing". It is likely that the sheet hinders the image formation processing by the second image forming unit 5 unless the sheet is cooled. Therefore, the CPU 801 temporarily puts the sheet on standby on the sheet conveying path from the fixing device 2 to the second image forming unit 5 until the temperature of the sheet falls to appropriate temperature (ACT 307). The CPU 801 feeds the sheet sufficiently cooled by being temporarily put on standby to the second image forming unit 5 and causes the second image forming unit 5 to execute image formation processing performed by using the erasable ink (ACT 308).

When the second image forming unit 5 executes the image formation processing performed by using the erasable ink, if the image formation processing by the first image forming unit 1 is performed immediately before the image formation processing, there is a concern that the sheet is affected by the heat of the fixing device 2 having high temperature. In such a case, if a sheet is fed from the stack 34 to the second image forming unit 5, the sheet is not affected by the heat of the fixing device 2.

After executing the print processing (ACT 308), if the next sheet as a target of the print processing is not present (No in ACT 309), the CPU 801 determines whether the stacking unit 34 is full (ACT 310).

If the stacking unit 34 is not full (No in ACT 310), the CPU 801 determines whether sheets are present in the cassette 33 that stores a sheet waiting for the "erasing processing" (ACT 311).

If sheets are present in the cassette 33 (Yes in ACT 311), if the temperature of the fixing device 2 is equal to or higher than the predetermined erasing temperature (e.g., 80° C.) (Yes in ACT 312), the CPU 801 performs sheet feeding from the cassette 33 (ACT 313) and causes the fixing device 2 to execute the erasing processing (ACT 314).

Specifically, when the CPU (the processing control unit) 801 causes the fixing device 2 to execute the "erasing processing", the CPU 801 causes the fixing device 2 to convey, before predetermined time elapses after the "fixing processing" by the fixing device 2 is completed, a sheet on which an image is formed with the erasing ink.

The sheet subjected to the erasing processing by the fixing device 2 is stored in the stacking unit 34. The sheet stored in the stacking unit 34 is fed to the second image forming unit 5 when the image formation processing is executed next by the second image forming unit 5 (ACT 304).

As explained above, the CPU (the processing control unit) 801 causes, in a period until the sheet subjected to the erasing processing by the fixing device 2 reaches the second image forming unit 5, the stacking unit 34 to stack the sheet and causes the sheet conveying unit to convey the stacked sheet to the second image forming unit 5.

With such a configuration, it is possible to put a sheet on standby after applying the erasing processing to the sheet. Therefore, it is possible to secure time for sufficiently cooling the sheet. No deficiency occurs in the image formation by the second image forming unit 5. It is possible to continuously apply the print processing performed by using erasable ink to sheets without causing useless waiting time.

Before the temperature of the fixing device 2 heated by the image formation processing falls, the erasing processing is applied to a sheet using the heat of the fixing device 2. Therefore, it is possible to contribute to power saving.

In the embodiment explained above, the determination concerning the "number of stacked sheets" as the number of sheets stacked in the stacking unit 34 may be realized by, for example, arranging a not-shown sensor or the like in the stacking unit 34 or may be realized by calculating, with the CPU (a number-of-stacked-sheets determining unit) 801, a difference between the number of sheets received in the stacking unit 34 and the number of sheets discharged from the stacking unit 34.

The operations in the processing in the image forming apparatus are realized by causing the CPU 801 to execute an image formation processing control program stored in the memory 802.

A computer program for causing a computer included in the image forming apparatus to execute the operations explained above can be provided as the image formation processing control program. In the examples explained in the embodiments, the computer program for realizing a function of carrying out the invention is stored in advance in a storage area provided in the apparatus. However, the present invention is not limited to this. The same computer program may be downloaded from a network to the apparatus. The same computer program stored in a computer-readable recording medium lay be installed in the apparatus. A form of the recording medium may be any form as long as the recording medium is a recording medium that can store the computer program and can be read by the computer. Specifically, examples of the recording medium include internal storage devices internally mounted in the computer such as a ROM and a RAM, portable storage media such as a CD-ROM, a flexible disk, a DVD disk, a magneto-optical disk, and an IC card, a database that stores a computer program, other computers and databases therefor and a transmission medium on a line. A function obtained by installation or download in advance in this way may be realized in cooperation with an OS (operating system) or the like in the apparatus.

The computer program may be an execution module that is dynamically generated partially or entirely.

The present invention can be carried out in various forms without departing from the spirit or the main characteristic thereof. Therefore, the embodiments described above are only an illustration in every aspect and should not be limitedly interpreted. The scope of the present invention is indicated by the scope of claims and is by no means limited by the text of the specification. Further, all modifications and various improvements, substitutions, and alterations belonging to the scope of equivalents of the scope of claims are within the scope of the present invention.

As explained above, according to the present invention, it is possible to provide a technique for, in an image forming apparatus having both of an image forming function of heat-fixing a colorant on a sheet using a fixing device and an image forming function of forming an image on the sheet using a colorant erasable by heating, making it possible to apply normal image formation processing using the erasable colorant to a sheet on which the image is erased by the fixing device.

What is claimed is:

1. An image forming apparatus comprising:

a first image forming unit configured to form an image on a sheet;

a first sheet feeding unit configured to feed a sheet on which an image is formed with a material that is erasable by heating;

a fixing device located on a downstream side of the first sheet feeding unit in a sheet conveying direction and configured to heat the sheet at a temperature above an erasing temperature;

a stacking unit located on a downstream side of the fixing device in the sheet conveying direction, configured to receive the sheet on which the image is erased by the fixing device, and configured to feed the sheet to the first image forming unit.

2. The image forming apparatus according to claim 1, wherein the stacking unit is located on a downstream side of the fixing device in the sheet conveying direction and is located on an upstream side of the first image forming unit in the sheet conveying direction.

3. The image forming apparatus according to claim 2, wherein the first image forming unit forms the image on the sheet with the material that is erasable by heating.

4. The image forming apparatus according to claim 3, further comprising, a second sheet feeding unit configured to feed a sheet on which no image is formed;

a second image forming unit configured to form an image on a sheet with a material that is fixed on the sheet by heating; and a control unit configured to change feeding of sheet in accordance with an instruction for forming the image with one of the first image forming unit and the second image forming unit.

5. The image forming apparatus according to claim 4, wherein the control unit drives the stacking unit to feed the sheet to the first image forming unit when the instruction is for forming the image with the first image forming unit, and wherein the control unit drives the second sheet feeding unit to feed the sheet to the second image forming unit when the instruction is for forming the image with the second image forming unit.

6. The image forming apparatus according to claim 1, further comprising, a second sheet feeding unit configured to feed a sheet on which no image is formed; and a control unit configured to drive the second sheet feeding unit to feed the sheet to the first image forming unit based on a determination that no sheet is stacked in the stacking unit, and to drive the stacking unit to feed the sheet to the first image forming unit based on a determination that the sheet is stacked in the stacking unit.

7. The image forming apparatus according to claim 1, further comprising a control unit that, based on a determination that the stacking unit is not filled with the sheet, drives the first sheet feeding unit to feed the sheet to the fixing unit, drives the fixing unit to heat the sheet at the temperature above the erasing temperature, and drives the stacking unit to receive the sheet from the fixing unit.

8. The image forming apparatus according to claim 7, wherein the control unit determines whether the stacking unit is filled with the sheet after an image forming process of the first image forming unit.

9. The image forming apparatus according to claim 1, further comprising, a driving source configured to move the stacking unit between a first state and a second state; and a control unit configured to control the driving source to move the stacking unit to the first state when feeding the sheet from the stacking unit, and drive the driving source to move the stacking unit to the second state when receiving the sheet in the stacking unit.

10. The image forming apparatus according to claim 9, further comprising a roller configured to rotate in a first direction to feed the sheet from the stacking unit and rotate in a second direction to receive the sheet in the stacking unit.

* * * * *